US005664966A

United States Patent [19]

Maegawa et al.

[11] Patent Number: 5,664,966

[45] Date of Patent: Sep. 9, 1997

[54] CONNECTOR WITH A CAP-TYPE RETAINER

[75] Inventors: Akihito Maegawa; Nobuyoshi Tanaka; Yukinori Saka; Kiyofumi Ichida, all of Yokkaichi, Japan

[73] Assignee: Sumitomo Wiring Systems, Ltd., Japan

[21] Appl. No.: 638,207

[22] Filed: Apr. 26, 1996

[30] Foreign Application Priority Data

Apr. 28, 1995 [JP] Japan ..... 7-128992

[51] Int. Cl.[6] ..... H01R 13/40

[52] U.S. Cl. ..... 439/595

[58] Field of Search ..... 439/595, 744

[56] References Cited

U.S. PATENT DOCUMENTS 4,944,695 7/1990 Tsuji et al. ..... 439/595

5,211,583 5/1993 Endo et al. ..... 439/595

FOREIGN PATENT DOCUMENTS 374 492 A3 6/1990 European Pat. Off. .

44 10 950 A1 3/1994 Germany .

5-65996 9/1993 Japan .

*Primary Examiner*—Neil Abrams

*Assistant Examiner*—Barry Matthew L. Standig

*Attorney, Agent, or Firm*—Banner & Witcoff, Ltd.

[57] ABSTRACT

A cap-shaped retainer 40 has a slit 43 formed therein for insertion of a separation plate, and terminal half-insertion detectors 41 projecting towards terminal fitting insertion chambers 21a of a housing 20. The detectors 41 project individually and are insertable into the lower portions of the respective terminal fitting insertion chambers 21a. The free ends of adjacent detectors 41 are connected to increase the strength thereof. The separation plate is insertable via the slit 43 since the half-insertion detectors 41 are connected beyond the inserted extent thereof.

10 Claims, 3 Drawing Sheets

CONNECTOR WITH A CAP-TYPE RETAINER

FIELD OF INDUSTRIAL APPLICATION

The present invention relates to a double-stopping connector, and particularly to a double-stopping electrical connector provided with a cap-type retainer.

BACKGROUND TO THE INVENTION

Conventional double-stopping electrical connectors have provided a cap-type retainer that fits the front side of a tubular housing; this fitting direction constitutes the attachment direction for terminal fittings of the connector. FIGS. 3 to 5 of this specification show a conventional double stopping connector. A female connector 1 comprises a housing 2, which has a main member 2*a* having terminal fitting insertion chambers 2*a*1 and a hood member 2*b* that envelops the main member 2*a*; a ring-shaped rubber seal 3 that fits within the hood member 2*b*; and a cap-shaped retainer 4 that is attachable to the front end of the main member 2*a*. As shown in FIGS. 4 and 5, the inner side face of the retainer 4 has terminal half-insertion detectors 4*a* formed thereon; these detectors 4*a* are inserted into the lower part of the terminal fitting insertion chambers 2*a*1 and can only be fully inserted if the terminal fitting is correctly installed; the detectors 4*a* thus indicate whether the terminal fittings are in a partly-inserted condition. One terminal half-insertion detector 4*a* is provided for each terminal fitting insertion chamber 2*a*1. In the embodiment illustrated, four terminal half-insertion detectors 4*a* are formed for the corresponding terminal fitting insertion chambers 2*a*1 formed in an upper and lower row, and to the left and to the right. Furthermore, a slit 4*b* is formed in the retainer and a slit 2*a*2 is formed in the main member 2*a* in a vertical direction (as viewed) to allow insertion of a flat separation plate of a corresponding male connector.

A conventional male connector 5 (FIG. 1) comprises a housing 7 consisting of a base member 7*a* that supports male terminal fittings 6; a hood member 7*b* that surrounds the male terminal fittings 6 and that can be inserted into the hood member 2*b*; and a separation plate 7*c* that projects in the direction of the slits 4*b* and 2*a*2 and that serves to prevent contact between adjacent terminals.

In use, female terminal fittings 9 are inserted into the terminal fitting insertion chambers 2*a*1 of the main member 2*a*, and the ring-shaped rubber seal 3 is slipped on to the peripheral face of the main member 2*a*. When the retainer 4 is attached from the front, the four terminal half-insertion detectors 4*a* are inserted into the lower parts of the terminal fitting insertion chambers 2*a*1. If the female terminal fittings 9 are not in a half-inserted position, the retainer 4 fits against the front portion of the main member 2*a*. After this, the male connector 5 is inserted into the hood member 2*b* of the female connector 1. At this juncture, the separation plate 7*c* passes into the slits 4*b* and 2*a*2, and the male terminal fittings 6 pass through the retainer 4 and are engaged in the terminal fitting insertion chambers 2*a*1.

FIG. 4 illustrates the case where a terminal fitting 9 is not fully inserted. The conventional latching arm or lance 8 is unable to engage an aperture in the underside of the terminal, and thus remains in a downward condition where it obstructs proper entry of the half insertion detector 4*a*. It will be appreciated that when the lance is in the upper condition and the detector 4*a* fully inserted, the terminal is doubly stopped since the lance is locked against movement.

In this manner the male connector 5 is inserted into the female connector 1, and the male terminal fittings 6 make contact with the female terminal fittings 9.

In the double-stopping connector as described above, a corresponding terminal half-insertion detector 4*a* projects for each terminal fitting insertion chamber 2*a*1, and as a result there is a problem that each terminal half-insertion detector 4*a* is relatively weak and easily broken.

The present invention has been developed taking the above problem into consideration, and aims at presenting a double-stopping connector in which the terminal half-insertion detector can be strengthened.

SUMMARY OF THE INVENTION

According to the invention there is provided a retainer for a connector having a plurality of terminals engageable in sockets thereof, said retainer having two projections fully engageable in respective sockets of the connector when terminals of the sockets are correctly inserted, and not fully engageable when terminals of the sockets are not correctly inserted, characterised in that the projections are joined at the free ends thereof by a substantially orthogonal linking portion.

The retainer is used in combination with a first connector comprising two terminal fitting insertion sockets for receiving respective terminal fittings in a terminal fitting insertion direction, said retainer being attachable to an end face of the housing and said sockets being connected by a slit adapted to receive said linking portion.

A second connector engageable with the first connector has a locking plate for engagement with the first connector in the terminal fitting insertion direction; the second connector having a separation plate for engagement in the first connector, a through slit being formed in the retainer to receive the separation plate, and said separation plate passing between said projections and towards said linking portion.

In the invention the cap-type retainer is attached to an end face of the first connector. Slits are formed in the retainer and the housing of the first connector to allow the insertion of the separation plate of the second connector. The projections of the retainer constitute half-insertion detectors that project into the terminal fitting insertion chambers of the first connector. The terminal half-insertion detectors are connected in pairs at the free ends, yet permit the insertion of the conventional separation plate. The terminal half-insertion detectors are thereby strengthened.

BRIEF DESCRIPTION OF DRAWINGS

Aspects of the present invention will be apparent from the following description of a preferred embodiment shown by way of example only in the accompanying drawings, in which.

DESCRIPTION OF THE PREFERRED EMBODIMENT

Figure 1:
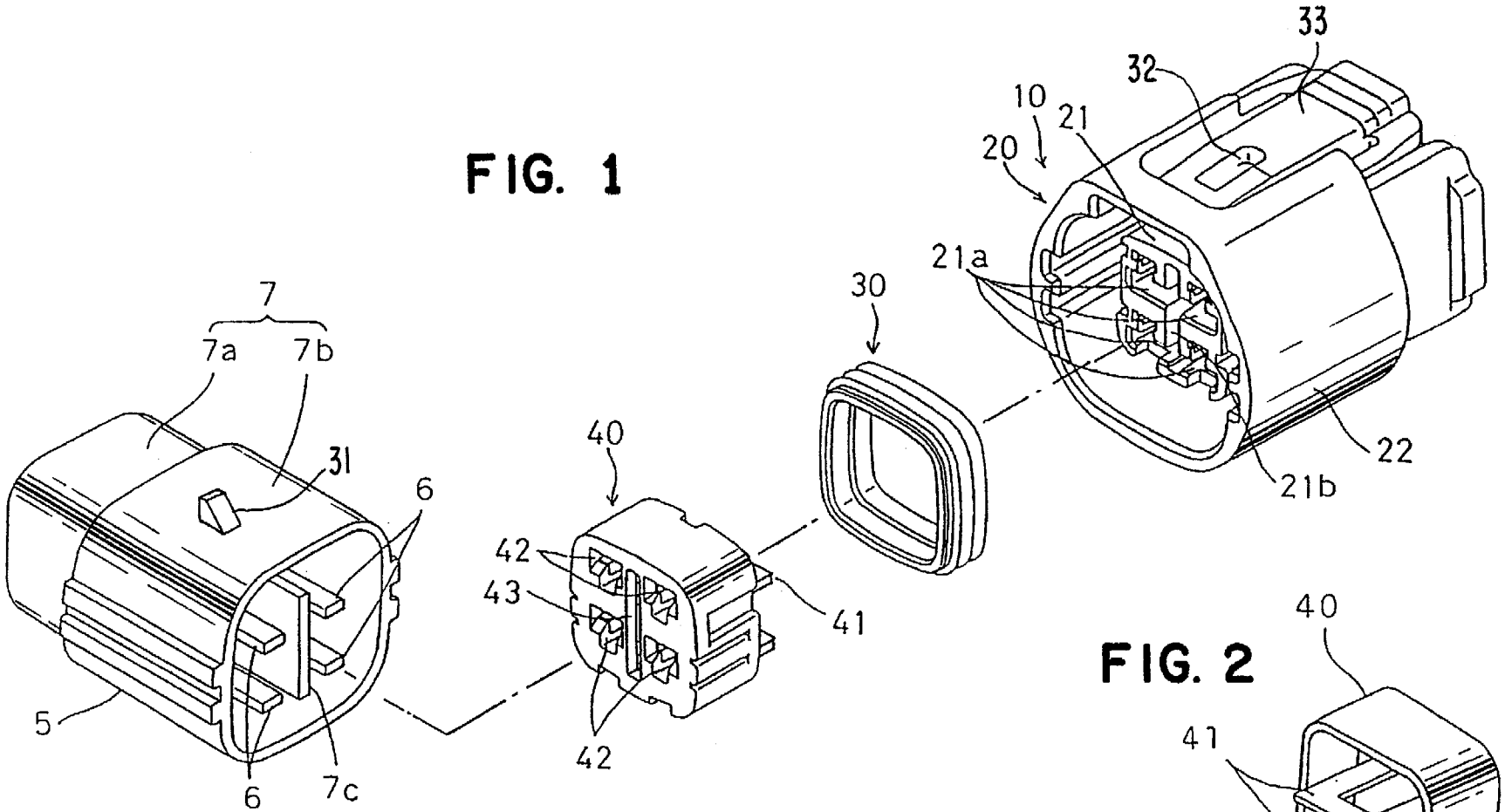
FIG. 1 is an exploded isometric view of a connector assembly relating to an embodiment of the present invention.
Figure 2:
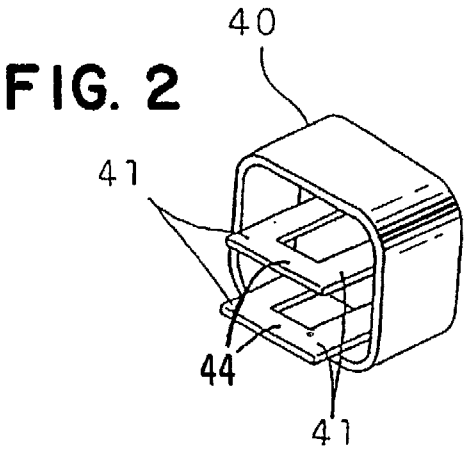
FIG. 2 is a schematic isometric view of the retainer of FIG. 1 as seen from the rear.
Figure 3:
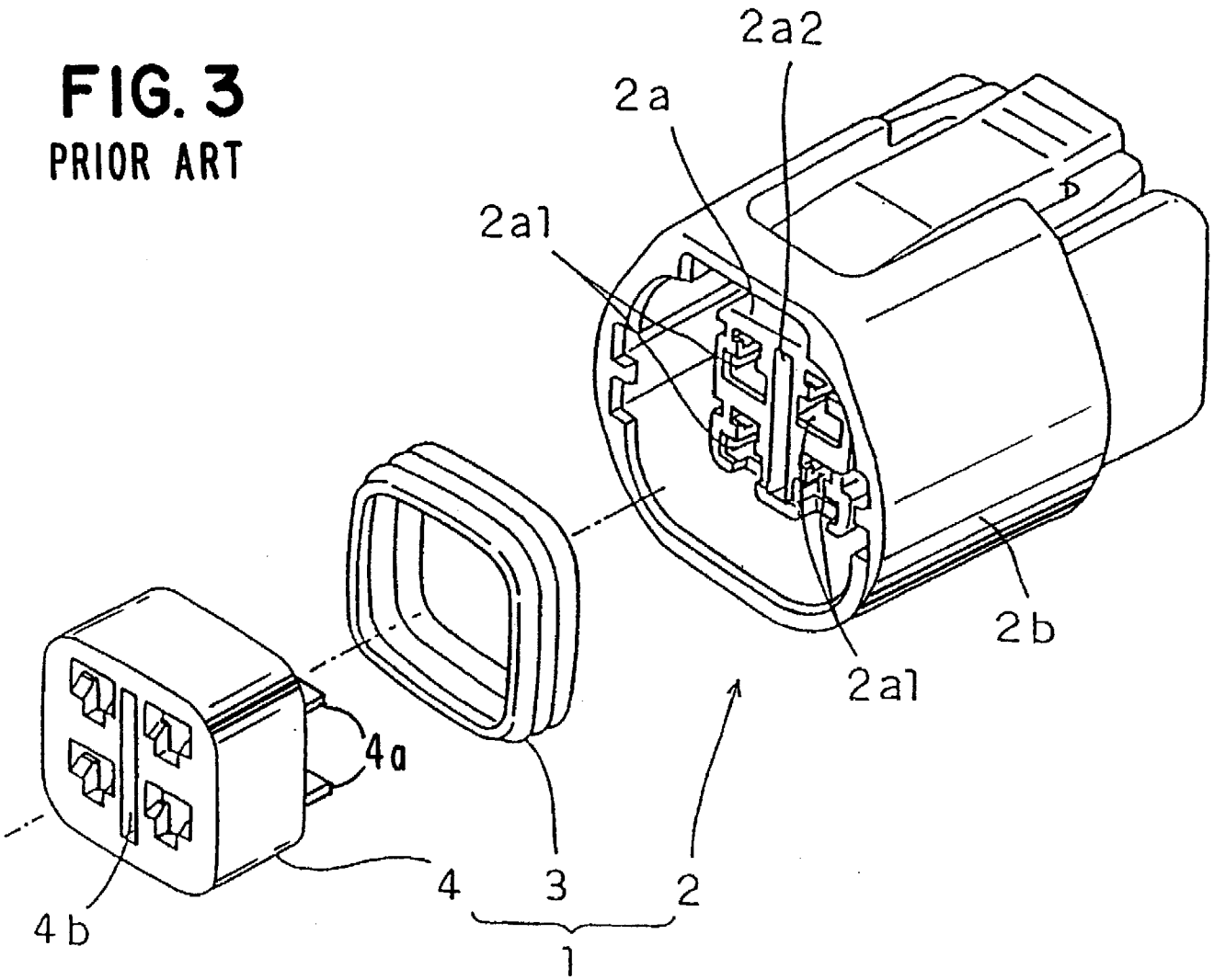
FIG. 3 PRIOR ART
FIG. 3 is an exploded isometric view of a prior art female water-proof connector using a conventional retainer.
Figure 4:
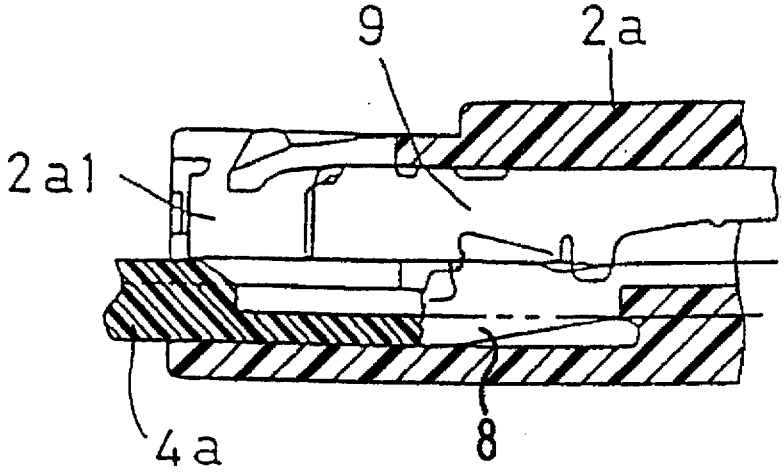
FIG. 4 PRIOR ART
FIG. 4 is a cross-sectional view through the housing of the female connector of FIG. 3.
Figure 5:
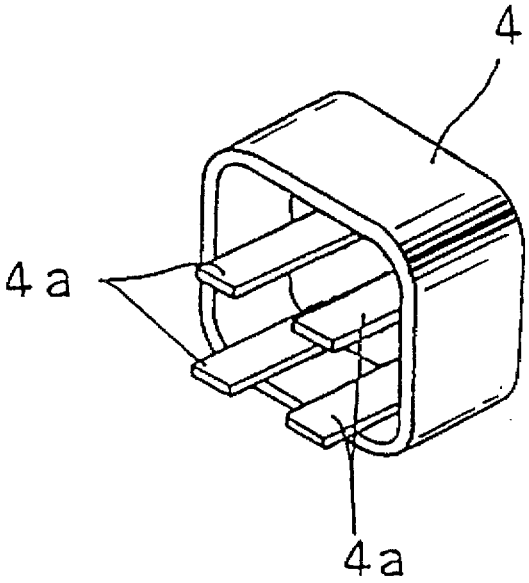
FIG. 5 PRIOR ART
FIG. 5 is a schematic isometric view of the retainer of FIG. 3 as seen from the rear.

With reference to FIGS. 1 and 2, a female connector 10 comprises a tubular cavity member 21 which has terminal fitting insertion chambers 21*a* to the left and right and on an upper and lower level; a housing consisting of a tubular hood member 22 that surrounds this cavity member 21, a ring-shaped rubber seal 30 that can fit onto the external peripheral face of the cavity member 21, and a cap-shaped retainer 40 that can fit so as to cover the front end of the cavity member 21.

Plate-shaped terminal half-insertion detectors 41 projecting from the rear face of the retainer 40 are insertable into portions formed on lower sides of the terminal fitting insertion chambers 21*a* located in the cavity member 21. The free ends of the terminal half-insertion detectors 41 on the left and right are mutually connected by a respective linking portion 44. Similarly, the lower portions of the terminal fitting insertion chambers 21*a* to the left and right are mutually connected.

A slit 21*b* is formed in an up-down direction (as viewed) in the cavity member 21 between the terminal fitting insertion chambers 21*a* provided to the left and right. The slit 21*b* extends into the terminal fitting insertion chambers 21*a* formed on both the upper and lower levels. Into this slit 21*b* is inserted a separation plate 7*c* located on the corresponding male connector 7.

In the retainer 40 are formed four terminal fitting insertion holes 42 facing the terminal fitting insertion chambers 21*a*. Furthermore, a slit 43 is formed between the terminal fitting insertion holes 42 located to the left and right. The slit 43 extends along the upper and lower levels where the terminal fitting insertion holes are located. The separation plate 7*c* of the male connector passes through this slit 43.

In this embodiment the female connector 10 is provided with a housing 20 having a hood member 22 that surrounds the cavity 21. However, as long as the cap-shaped retainer 40 is attachable to the front end of the cavity member 21, the hood member 22 may not be necessary. Similarly, the rubber seal 30 is not indispensable.

The male and female connectors are latched by a respective projection 31 and aperture 32 provided on a resilient arm 33. Such a latch is conventional and gives snap fitting engagement. Disengagement is by lifting the arm 33 and pulling the connector apart.

In use, female terminal fittings are inserted into each of the terminal fitting insertion chambers 21*a* and the rubber seal 30 is attached to the external periphery of the cavity member 21. The retainer 40 is attached to the outer end of the cavity member 21 and the ends of the terminal half-insertion detectors 41 are inserted fully into the corresponding cavity 21*a* of the terminal fittings are correctly installed.

When the corresponding male connector is inserted, the separation plate passes through the slit 43 and into the slit 21*b*. Since the terminal half-insertion detectors 41 on the left and right mutually and independently project, insertion proceeds without interference. The terminal half-insertion detectors 41 are longer than the separation plate and remain connected inwardly of the plate. Accordingly, the connected portion of the detectors 41 does not interfere with the insertion of the separation plate. Compared to the conventional case where four individual terminal half-insertion detectors 41 are provided, the strength is increased.

We claim:

1. A retainer for a connector having a plurality of sockets and a terminal insertable in each socket thereof, said retainer having two projections, one each fully engageable in a respective socket of the connector when terminals of the sockets are correctly inserted, and not fully engageable when terminals of the sockets are not correctly inserted, wherein the projections are joined at the free ends thereof by a substantially orthogonal linking portion.

2. A retainer according to claim 1 wherein said projections and linking portion are laminar and coplanar.

3. A retainer according to claim 1 wherein projections are substantially identical.

4. A retainer according to claim 3 wherein said projections and linking portion are laminar and coplanar.

5. A retainer according to claim 4 wherein four projections are provided, respective linking portions connecting pairs of projections and the linking portions being parallel.

6. A retainer according to claim 5 wherein the projections associated with each linking portion are equi-spaced.

7. A retainer according to claim 6 wherein the projections are symmetrical about a mid-plane thereof.

8. A retainer according to claim 1 in combination with a first connector, the first connector comprising two terminal insertion sockets for receiving respective terminals in a terminal fitting insertion direction, said retainer being attachable to an end face of the housing in the opposite direction to said insertion direction and said sockets being connected by a slit adapted to receive said linking portion.

9. A retainer according to claim 8 and further comprising a second connector engeageable with the first connector in the retainer attachment direction and having terminals engageable with the terminals of the first connector; the second connector having a separation plate between respective terminals and for engagement in the first connector, a through slit being formed in the retainer to receive the separation plate, and said separation plate passing between said projections and towards said linking portion.

10. A connector assembly comprising a first connector, a second connector and a retainer, the first and second connectors having two respective terminal insertion sockets and terminals within the sockets for mutual paired engagement, and the retainer being engageable in the first connector prior to connection of the first and second connectors and having two projections engageable one each in a respective terminal insertion socket of the first connector, the projections being joined at their free ends by a substantially orthogonal linking portion, the terminal insertion sockets of the first connector being linked by a through slit to receive said linking portion, and the retainer having through apertures to receive the terminals of the second connector.

* * * * *